US007376994B2

(12) United States Patent
Wu

(10) Patent No.: US 7,376,994 B2
(45) Date of Patent: May 27, 2008

(54) MULTI-FUNCTIONAL INFLATABLE BED

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 5 days.

(21) Appl. No.: 11/489,755

(22) Filed: Jul. 19, 2006

(65) Prior Publication Data

US 2007/0169272 A1 Jul. 26, 2007

(30) Foreign Application Priority Data

Jan. 24, 2006 (CN) ..... 2006 2 0054390 U
Jan. 24, 2006 (CN) ..... 2006 2 0054391 U

(51) Int. Cl.
*A47C 27/00* (2006.01)

(52) U.S. Cl. ..... 5/694; 5/904; 5/905

(58) Field of Classification Search ..... 5/694, 5/713, 904, 905
See application file for complete search history.

(56) References Cited

U.S. PATENT DOCUMENTS 3,841,587 A * 10/1974 Freed ..... 244/199.3
4,856,087 A * 8/1989 Nesbit ..... 455/344
6,543,073 B2 * 4/2003 Wu ..... 5/713
6,836,914 B1 * 1/2005 Tsai ..... 5/713
6,955,527 B2 * 10/2005 Yen ..... 417/360
7,039,972 B2 * 5/2006 Chaffee ..... 5/706

* cited by examiner

*Primary Examiner*—Michael Trettel
(74) *Attorney, Agent, or Firm*—Allston L Jones

(57) ABSTRACT

An inflatable bed includes an inflatable bed body having a top layer, a bottom layer, and an annular surrounding layer interconnecting the top and bottom layers and cooperating with the top and bottom layers to define an inflatable space. The surrounding layer is formed with an accommodating groove unit. An air valve is disposed on the inflatable bed body.

6 Claims, 4 Drawing Sheets

MULTI-FUNCTIONAL INFLATABLE BED

CROSS-REFERENCE TO RELATED APPLICATIONS

This application claims priority of Chinese Applications Nos. 200620054391.6 and 200620054390.1, both filed on Jan. 24, 2006.

BACKGROUND OF THE INVENTION

1. Field of the Invention

The invention relates to an inflatable bed, more particularly to a multi-functional inflatable bed.

2. Description of the Related Art

An inflatable device, such as an inflatable pad, an inflatable bed or an inflatable chair, can be used in outdoor activities, such as camping.

A conventional inflatable bed merely serves as a bed. During outdoor use, in addition to an inflatable bed, electronic devices, for example, a clock, a radio and a flashlight, may be required. Therefore, it is desirable to design a multi-functional inflatable bed.

SUMMARY OF THE INVENTION

Therefore, the object of the present invention is to provide a multi-functional inflatable bed that has an accommodating groove unit for receiving an electronic device.

According to the present invention, an inflatable bed comprises:

an inflatable bed body having a top layer, a bottom layer, and an annular surrounding layer interconnecting the top and bottom layers and cooperating with the top and bottom layers to define an inflatable space, the surrounding layer being formed with an accommodating groove unit; and an air valve disposed on the inflatable bed body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
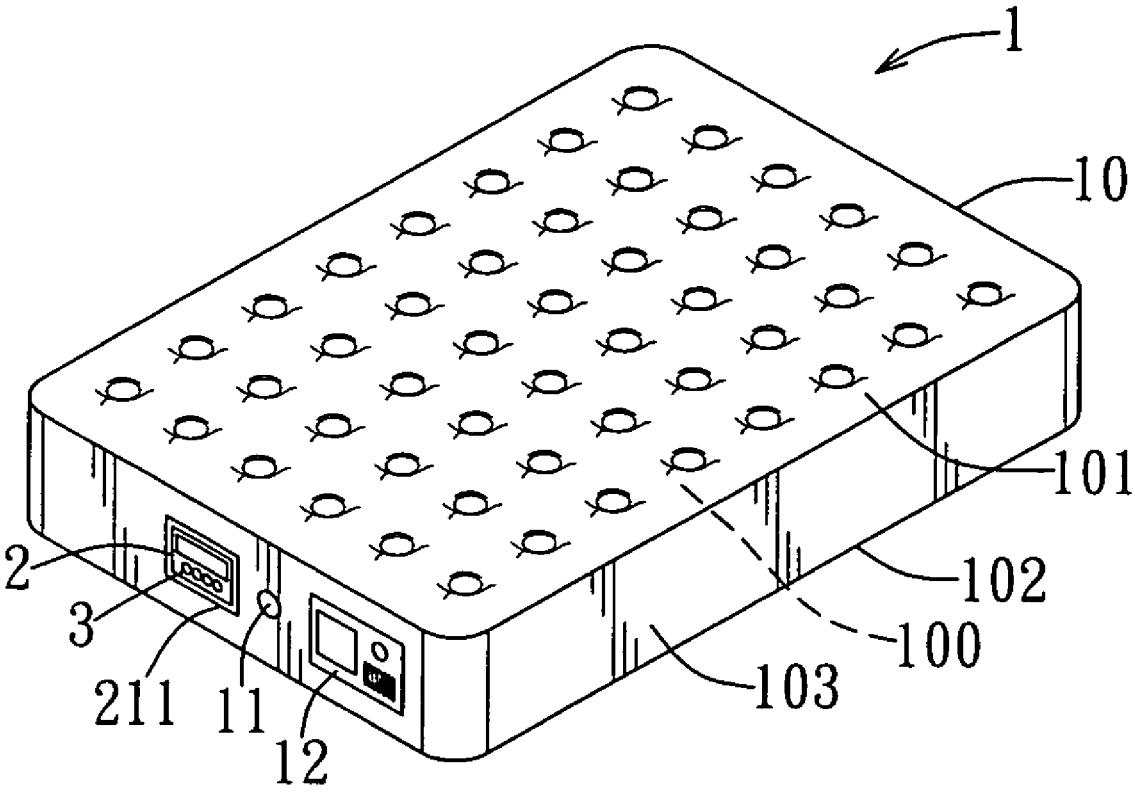
FIG. 1 is a perspective view showing the first preferred embodiment of an inflatable bed according to the present invention.

Before the present invention is described in greater detail, it should be noted that like elements are denoted by the same reference numerals throughout the disclosure.

Figure 2:
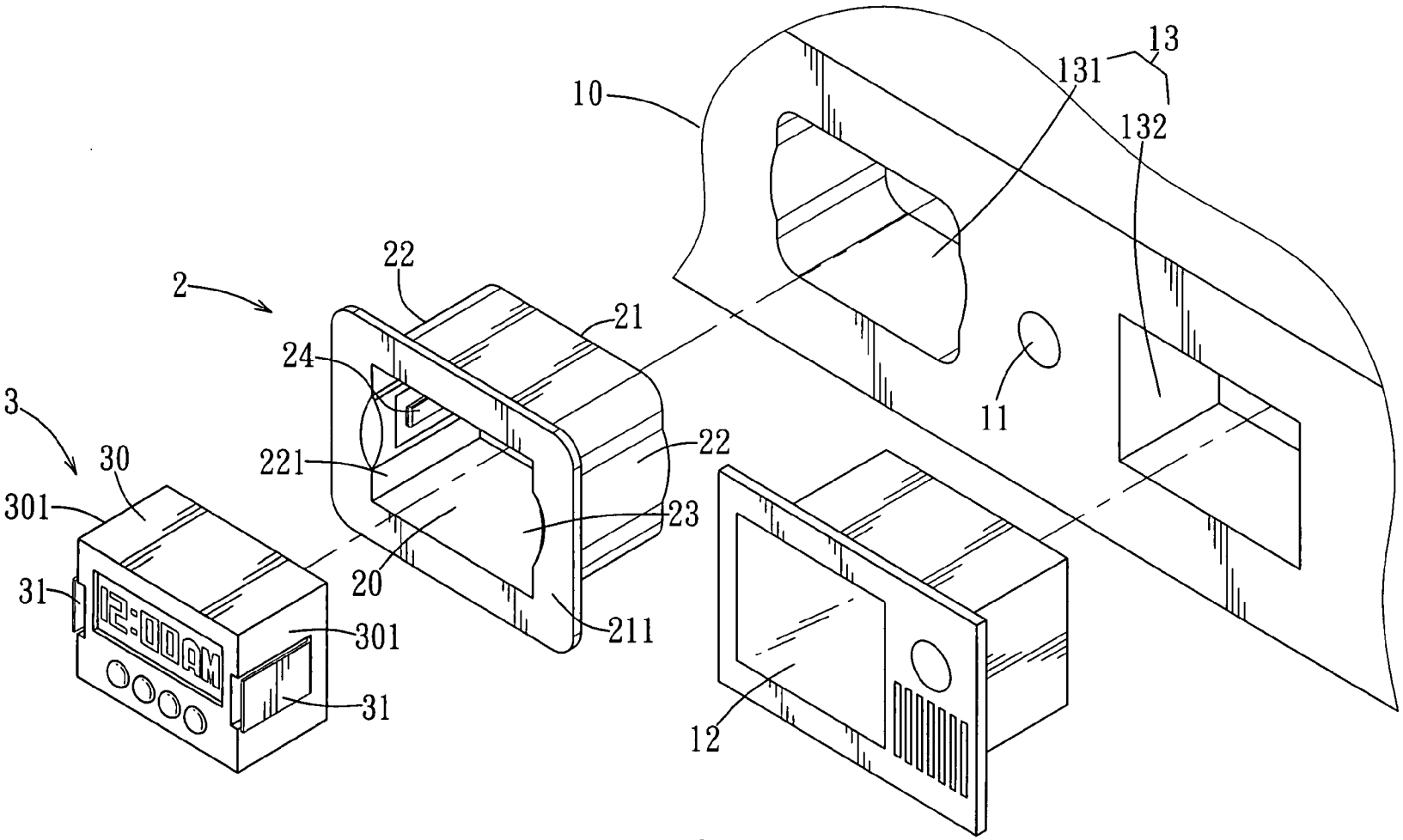
FIG. 2 is an exploded fragmentary perspective view showing the first preferred embodiment.

Referring to FIGS. 1 and 2, the first preferred embodiment of an inflatable bed 1 according to the present invention is shown to include an inflatable bed body 10, an air valve 11, an air pump unit 12, a mounting frame 2, a portable electronic device 3, and a positioning unit.

The inflatable bed body 10 has a top layer 101, a bottom layer 102, and an annular surrounding layer 103 interconnecting the top and bottom layers 101, 102 and cooperating with the top and bottom layers 101, 102 to define an inflatable space 100. The surrounding layer 103 is formed with an accommodating groove unit 13. In this embodiment, the accommodating groove unit 13 includes first and second grooves 131, 132.

The air valve 11 is disposed on the surrounding layer 103 of the inflatable bed body 10.

In this embodiment, the air pump unit 12 is received in the second groove 132 of the accommodating groove unit 13 in the surrounding layer 103 of the inflatable bed body 10 for injecting air into and expelling air from the inflatable space 100 in the inflatable bed body 10 via the air valve 11.

In this embodiment, the mounting frame 2 has a frame body 21 that is disposed fittingly and fixedly in the first groove 131 of the accommodating groove unit 13 in the surrounding layer 103 of the inflatable bed body 10 and that is configured with a receiving space 20. The mounting frame 2 has an open side 23 for access into the receiving space 20. The frame body 21 has opposite lateral walls 22, each of which has an inner surface 221. The mounting frame 2 further has an annular coupling flange 211 extending outwardly from the open side 23 and attached fixedly to the surrounding layer 103 of the inflatable bed body 10, as shown in FIG. 1.

In this embodiment, the portable electronic device 3, such as a clock, a radio or a flashlight, is mounted fittingly and removably in the receiving space 20 in the frame body 21 of the mounting frame 2 via the open side 23 of the mounting frame 2. The portable electronic device 3 includes a housing 30 that has opposite side surfaces 301 corresponding respectively to the inner surfaces 221 of the lateral walls 22 of the frame body 21 of the mounting frame 2.

The positioning unit positions the portable electronic device 3 in the receiving space 20 in the frame body 21 of the mounting frame 2. In this embodiment, the positioning unit includes a pair of first resilient pieces 24 (only one is shown in FIG. 2), and a pair of second resilient pieces 31. The first resilient pieces 24 are disposed on and project from the inner surfaces 221 of the lateral walls 22 of the frame body 21 of the mounting frame 2, respectively. The second resilient pieces 31 are disposed on and project from the opposite side surfaces 301 of the housing 30 of the portable electronic device 3, respectively. The first resilient pieces 24 abut respectively against the second resilient pieces 31 when the electronic device 3 is mounted in the receiving space 20 in the frame body 21 of the mounting frame 2.

Figure 3:
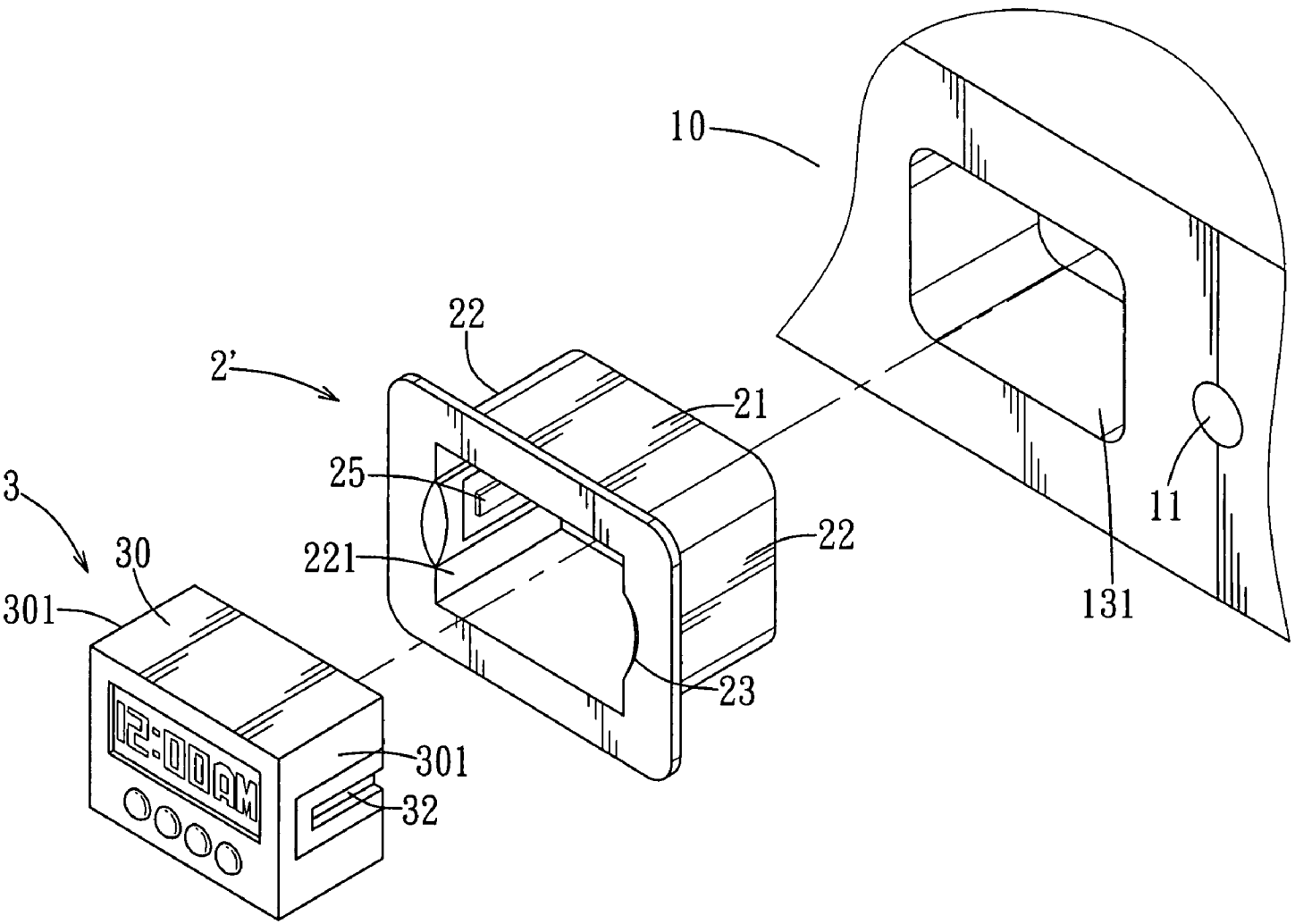
FIG. 3 is an exploded fragmentary perspective view showing the second preferred embodiment of an inflatable bed according to the present invention.

FIG. 3 illustrates the second preferred embodiment of an inflatable bed according to this invention, which is a modification of the first preferred embodiment. In this embodiment, the positioning unit includes a pair of guide rails 25 (only one is shown), and a pair of guiding grooves 32 (only one is shown). The guide rails 25 are disposed fixedly on and project from the inner surfaces 221 of the lateral walls 22 of the frame body 21 of the mounting frame 2, respectively. The guiding groves 32 are formed respectively in the opposite side surfaces 301 of the housing 30 of the portable electronic device 3. Each of the guide rails 25 engages movably a corresponding one of the guiding grooves 32 when the portable electronic device 3 is mounted in the receiving space 20 in the frame body 21 of the mounting frame 2.

Figure 4:
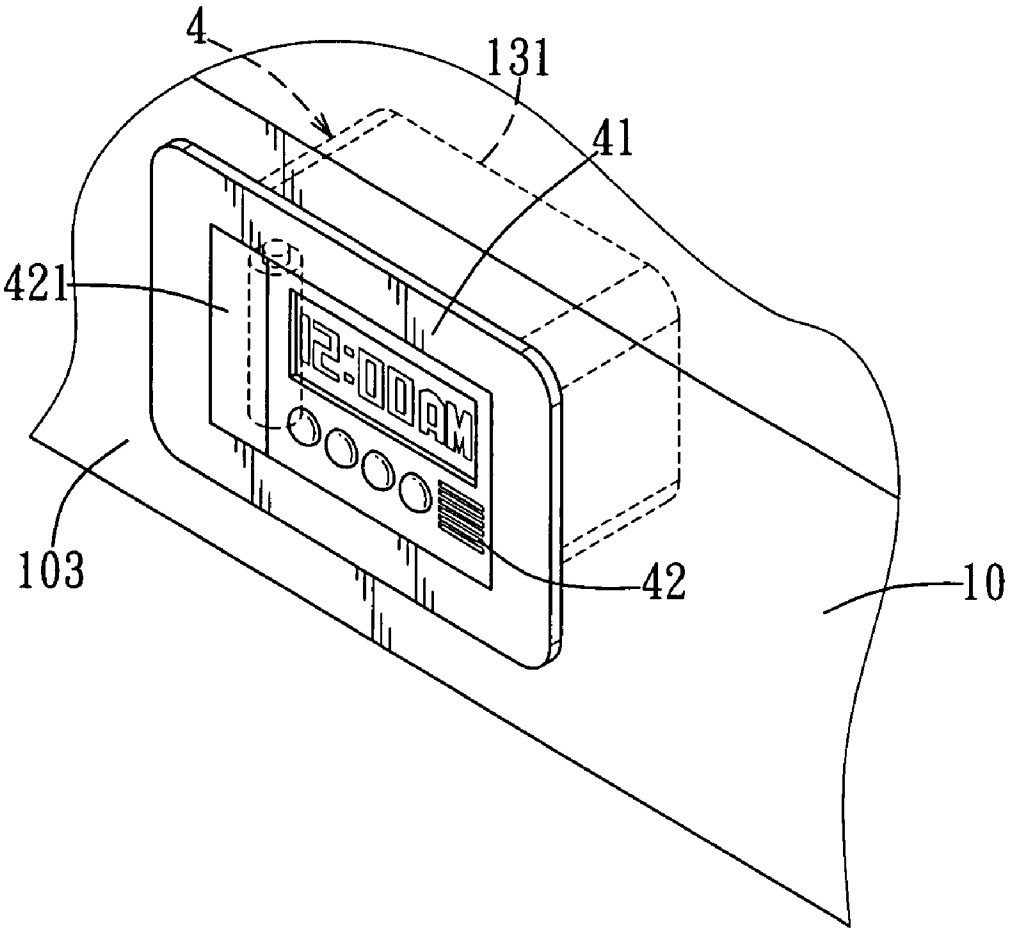
FIG. 4 is a fragmentary perspective view showing the third preferred embodiment of an inflatable bed according to the present invention.

FIG. 4 illustrates the third preferred embodiment of an inflatable bed according to the present invention, which is modification of the first preferred embodiment. The inflatable bed of the third preferred embodiment differs from the first preferred embodiment in that the mounting frame 2 and the positioning unit of the first preferred embodiment are omitted, and that the electronic device 4 is disposed fittingly and fixedly in the first groove 131 of the accommodating groove unit in the surrounding layer 13 of the inflatable bed body 10. In this embodiment, the electronic device 4 has a side 42 exposed to the outside of the first groove 131 of the accommodating groove unit in the surrounding layer 103 of the inflatable bed body 10, and an annular coupling flange 41 extending outwardly from the side 42 and attached fixedly to the surrounding layer 103 of the inflatable bed body 10. The side 42 of the electronic device 4 is formed with a battery-receiving groove 421.

In sum, since the electronic devices 3, 4, which serve as a clock in these embodiments, can provide time information, multi-functionality of the inflatable bed of this invention can be achieved when used outdoors.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable bed comprising:

an inflatable bed body having a top layer, a bottom layer, and an annular surrounding layer interconnecting said top and bottom layers and cooperating with said top and bottom layers to define an inflatable space, said surrounding layer being formed with an accommodating groove unit;

an air valve disposed on said inflatable bed body;

a mounting frame disposed fittingly and fixedly in said accommodating groove unit in said surrounding layer of said inflatable bed body and configured with a receiving space, said mounting frame having an open side for access into said receiving space, and opposite lateral walls, each of which has an inner surface;

a portable electronic device mounted fittingly and removably in said receiving space in said mounting frame via said open side of said mounting frame, and includes a housing that has opposite side surfaces corresponding respectively to said inner surfaces of said lateral walls of said mounting frame; and a positioning unit for positioning said portable electronic device in said receiving space in said mounting frame, said positioning unit includes:

a pair of first resilient pieces disposed on and protecting from said inner surfaces of said lateral walls of said mounting frame, respectively, and a pair of second resilient pieces disposed on and projecting from said opposite side surfaces of said housing of said portable electronic device, respectively, said first resilient pieces abutting respectively against said second resilient pieces when said portable electronic device is mounted in said receiving space in said mounting frame.

2. The inflatable bed as claimed in claim 1, further comprising an air pump unit received in said accommodating groove unit in said surrounding layer of said inflatable bed body for injecting air into and expelling air from said inflatable space in said inflatable bed body via said air valve.

3. The inflatable bed as claimed in claim 1, wherein said mounting frame has an annular coupling flange extending outwardly from said open side and attached fixedly to said surrounding layer of said inflatable bed body.

4. An inflatable bed comprising:

an inflatable bed body having a top layer, a bottom layer, and an annular surrounding layer interconnecting said top and bottom layers and cooperating with said top and bottom layers to define an inflatable space, said surrounding layer being formed with an accommodating groove unit;

an air valve disposed on said inflatable bed body;

a mounting frame disposed fittingly and fixedly in said accommodating groove unit in said surrounding layer of said inflatable bed body and configured with a receiving space, said mounting frame having an open side for access into said receiving space, and opposite lateral walls, each of which has an inner surface;

a portable electronic device mounted fittingly and removably in said receiving space in said mounting frame via said open side of said mounting frame, and including a housing that has opposite side surfaces corresponding respectively to said inner surfaces of said lateral walls of said mounting frame; and a positioning unit for positioning said portable electronic device in said receiving space in said mounting frame, said positioning unit including:

a pair of guide rails disposed fixedly on and projecting from said inner surfaces of said lateral walls of said mounting frame, respectively, and a pair of guiding grooves formed respectively in said opposite side surfaces of said housing of said portable electronic device, each of said guide rails engaging movably a corresponding one of said guiding grooves when said portable electronic device is mounted in said receiving space in said mounting frame.

5. The inflatable bed as claimed in claim 4, further comprising an air pump unit received in said accommodating groove unit in said surrounding layer of said inflatable bed body for injecting air into and expelling air from said inflatable space in said inflatable bed body via said air valve.

6. The inflatable bed as claimed in claim 4, wherein said mounting frame has an annular coupling flange extending outwardly from said open side and attached fixedly to said surrounding layer of said inflatable bed body.

* * * * *